United States Patent [19]

Divisek et al.

[11] Patent Number: 4,857,153

[45] Date of Patent: Aug. 15, 1989

[54] PROCESS FOR THE PRODUCTION OF POROUS ELECTRODES

[75] Inventors: Jiri Divisek; Heinz Schmitz, both of Jülich, Fed. Rep. of Germany

[73] Assignee: Kernforschungsanlage Juelich Gesellschaft mit beschrankter Haftung, Juelich, Fed. Rep. of Germany

[21] Appl. No.: 284,357

[22] Filed: Dec. 14, 1988

[30] Foreign Application Priority Data

Dec. 21, 1987 [DE] Fed. Rep. of Germany ..... 3743354

[51] Int. Cl.[4] ..... C25D 5/00

[52] U.S. Cl. ..... 204/16; 204/38.1

[58] Field of Search ..... 204/16, 38.1, 38.4

[56] References Cited

U.S. PATENT DOCUMENTS

| | | | |
|---|---|---|---|
| 4,240,895 | 12/1980 | Gray | 204/290 R |
| 4,300,993 | 11/1981 | Divisek et al. | 204/290 R |
| 4,302,322 | 11/1981 | Oda et al. | 204/293 |
| 4,584,065 | 4/1986 | Divisek et al. | 204/11 |

FOREIGN PATENT DOCUMENTS

| | | |
|---|---|---|
| 2829901 | 1/1980 | Fed. Rep. of Germany . |
| 2015032 | 9/1979 | United Kingdom . |

OTHER PUBLICATIONS

Justi et al., "Kalte Verbrennung," Franz Steiner Verlag GmbH, Wiesbaden 1962, pp. 8, 110.

Veziroglu et al., (editors), "Hydrogen Energy Progress V," Proceedings of the 5th World Hydrogen Energy Conference, Toronoto, Canada, Jul. 15–20, 1984, p. 933.

Mueller et al., "Raney-Nickel-beschichtete Elektroden," Chem.-Ing.-Tech. 52, 1980, Nr. 5, pp. 435–436.

INCO-Nickelpulver, Eigenschaften und Verwendung, pp. 3–9.

*Primary Examiner*—T. M. Tufariello

*Attorney, Agent, or Firm*—Foley & Lardner, Schwartz, Jeffery, Schwaab, Mack, Blumenthal & Evans

[57] ABSTRACT

Porous electrodes are obtained by a method in which a layer of a powder mixture comprising (a) finely divided carbonyl metal having a low bulk density and high frictional resistance and (b) a pulverulent component which is catalytically active or can be activated by alkali treatment, in an a/b ratio of about 3:1 to 1:3, is applied by rolling to one or both sides of a framework-forming metallic substrate having adhesion-promoting surface roughness, and said layer is consolidated by electrodeposition of metal, after which activation is finally effected if necessary. Superficial oxidation of the powder particles, which decreases from the outer surface of the layer toward the support and gradually dissolves in the electroplating bath, promotes extensive consolidation of the layer by electrodeposition.

28 Claims, No Drawings

PROCESS FOR THE PRODUCTION OF POROUS ELECTRODES

BACKGROUND OF THE INVENTION

The present invention relates to a process for the production of porous electrodes, in which a porous metal layer is produced on a framework-forming metallic support having adhesion-promoting surface roughness, is provided with an electrochemically deposited metal in the pores and, if necessary, is activated by treatment with alkali. The present invention further relates to a porous electrode produced by said process.

Active electrodes at which only low overvoltages occur constitute one of the most important preconditions for an economical procedure in electrochemical process engineering. In the case of alkaline electrolyses, such as the electrolysis of an alkali metal chloride or the electrolysis of water, active electrodes based on Raney nickel are usually used. In addition to low overvoltages, such electrodes are also required to have other properties, in particular:

sufficient mechanical strength of the catalyst layer;
economical production even of large units;
applicability with "zero-gap" cell designs (with "zero spacing" between diaphragm and electrode);
homogeneous current density distribution in "zero-gap" cells; and
low-loss transfer of electric charge between the support and the catalyst.

There are already various known processes for the production of such electrodes. Essentially, an Ni/Al or Ni/Zn alloy, which can be activated, is applied in such processes to an electrically conductive support, from which alloy the soluble component (Al, Zn) is removed by subsequent treatment with an alkali. As a result, a catalytically active Ni structure (Raney nickel) remains. However, the electrodes obtained by the known processes are not completely satisfactory in one respect or another.

For example, according to E. Justi and A. Winsel ("Kalte Verbrennung" [Cold Combustion], Franz Steiner Verlag, 1962, Chapter 4.1), a sintered self-supporting catalyst electrode is produced by a compression or rolling process coupled with a sintering process. However, the said electrode has insufficient mechanical strength at small layer thickness and can be produced only in relatively small dimensions.

Electrodes produced by electrodeposition from suspension (British Pat. No. 2,015,032; U.S. Pat. No. 4,302,322) can be produced only in relatively small units since the electrically conductive suspensions permit regular deposition only at low substrate heights. Moreover, it is impossible to achieve a sufficiently high catalyst concentration with this technique.

Intermetallic diffusion or electrodeposition of an Ni/Zn alloy (U.S. Pat. No. 4,240,895; German Pat. No. 3,330,961) gives electrodes whose structure is not very suitable for low-loss charge transfer.

By plasma spraying ("Hydrogen Energy Progress" V by T. N. Veziroglu and J. B. Taylor (Editors); Pergamon Press, New York, page 933), it is scarcely possible to produce uniform electrodes in the industrially relevant size.

Technically the most mature process is that of reductive powder plating (German Offenlegungsschrift No. 2,829,901; Chem.-Ing.-Technik 5 (1980), 435), which is based on the following principle:

> A spreadable paste of a powder mixture of Ni/Al and Ni in 50% of alcohol and 1% of methylcellulose is applied to a sheet metal support and dried. The sheet coated in this manner is then rolled down to about 50% in a cold rolling mill, so that the catalytic powder layer is highly compacted and mechanically bonded to or in the matrix. The powder is subjected to reductive welding by brief annealing at 700° C. in a $H_2$ atmosphere. This results in a catalyst layer which can be activated and which adheres firmly to the electrically conductive, mechanically stable electrode support.

Although electrodes of this type have excellent catalytical activity and mechanical strength, only continuous ("solid") smooth electrodes can be produced, owing to the necessary deformation of the sheet metal support. However, such geometric structures are not very suitable in the "zero-gap" configuration in gas-evolving electrochemical reactions. The geometric form of a perforated metal sheet or expanded metal is known to be necessary for this purpose.

Finally, German Pat. No. 2,914,094 of the Applicant describes a process in which a porous electrode layer is formed on a metal support, such as nickel net or iron net, by sintering an applied suspension of nickel powder, or powder containing a nickel alloy, and pore-forming substances, on which electrode layer a nickel/-zinc alloy is deposited electrolytically. Finally, zinc is dissolved away from this electrochemically coated sintered element by immersion in a alkali, which can, if necessary, be carried out in situ when the electrodes are used.

With such electrodes, too, marked overvoltages are still measured.

SUMMARY OF THE INVENTION

Accordingly, it is an object of the present invention to provide a process for the production of active porous electrodes at which low overvoltages occur.

Another object of the present invention is to provide a process for the production of porous electrodes whereby the mechanical strength of the catalyst layer is improved.

A further object of the present invention is to provide a process suitable for the production of porous electrodes of large dimension.

A still further object of the present invention is to provide a process for the production of porous electrodes which promotes extensive consolidation of the catalyst layer.

Yet another object of the present invention is to provide a porous electrode produced by an improved process.

In accomplishing the foregoing objectives, there has been provided, in accordance with one aspect of the present invention, a process for the production of porous electrodes comprising the steps of: applying by dry rolling to at least one side of a framework-forming metallic support having adhesion-promoting surface roughness a layer which comprises a powder mixture comprising (a) finely divided carbonyl metal having a low bulk density and high frictional resistance and (b) a pulverulent component comprising a compound which is catalytically active or a compound which can be activated by alkali treatment, wherein the ratio of component (a) to component (b) is between about 3:1 and 1:3; and consolidating said layer by electrochemical coating with metal. In a particular embodiment, said pulverulent component can be activated by alkali treatment, and the process comprises the further step of activating said layer. In a preferred embodiment, carbonyl nickel is used as component (a) of the powder mixture.

In accordance with another aspect of the present invention there has been provided a process for the production of porous electrodes comprising the steps of: preparing a powder mixture comprising (a) finely divided carbonyl metal having a low bulk density and high frictional resistance, and (b) a pulverulent component comprising a compound which is catalytically active or a compound which can be activated by alkali treatment, wherein the ratio of component (a) to component (b) is between about 3:1 and 1:3; dividing said powder mixture into a plurality of portions; superficially oxidizing at least one portion of said powder mixture; applying to at least one side of a framework-forming metallic support having adhesion-promoting roughness a layer formed by a process comprising the steps of: (i) superimposing on a flat substrate said plurality of powder mixture portions in order of decreasing superficial oxidation; (ii) superimposing said metallic support on said powder layers; (iii) uniting said powder layers and said metallic support by dry rolling; and (iv) removing said flat substrate; and consolidating the combined powder layer by electrochemical coating with metal.

In accordance with yet another aspect of the present invention, there have been provided porous electrodes produced by said processes.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DETAILED DESCRIPTION OF THE PREFERRED EMBODIMENTS

According to the invention, a powder which is catalytically active or which can be activated is applied, by dry rolling, to one or both sides of a framework-forming support having the properties of a metallic conductor and an adhesion-promoting surface. Component (a) of said powder has adhesion-promoting, "felting" properties, as found, in particular, in the case of carbonyl nickel having a mean particle size (according to Fisher) of 2.2 to 3.0 μm, a bulk density of 0.5 to 0.65 g/cm$^3$, a specific surface area of 0.68 m$^2$/g and an angle of repose of 70° (INCO 255). This process yields a conveniently handled element, which is consolidated by electrode position of metal and, if necessary, finally activated by leaching with an alkali.

The support used is preferentially a fine-mesh metal net, or a perforated metal sheet having a roughened surface, which is obtained, for example, by sand blasting, flame spraying or chemical treatment. A steel net or nickel net having a small mesh size of about 200 to 600 μm, which prevents the powder layer from falling through, is preferred. A perforated nickel sheet which has been roughened by electrodeposition of carbonyl nickel powder (for example 1–5 mg/cm$^2$ powder deposited in a nickel-plating bath), and on which layers applied by dry rolling show excellent adhesion but can readily be removed from the holes by gentle vibration (tapping), is particularly preferred.

Carbonyl iron powder or carbonyl nickel powder, and in particular carbonyl nickel having a particle size of about 2 to 3 μm and a bulk density of about 0.5 to 0.7 g/cm$^3$, is preferably used as component (a) of the powder mixture.

A material which is catalytically active or can be activated by alkali treatment, such as, in particular, nickel sulfide, molybdenum sulfide or an alloy of molybdenum as an example of cathodic catalyst, or semiconducting oxides such as cobalt oxide, nickel cobalt oxide as an example of anodic catalyst, or nickel with aluminium, zinc, tin, etc., is used as component (b). The components (a) and (b) are used in a ratio of about 3:1 to 1:3, in particular 2:1 to 1:2, but preferably in a ratio of 1:1 (by weight) and in approximately similar particle size, and the component (b) may furthermore be somewhat coarser and may have particle sizes in the range from about 10 to 100 μm.

In addition, the powder mixture can contain about 5 to 20% by weight (based on the mixture of (a) and (b)) of a filler which can be removed by dissolution or sublimation, such as, for example, KCl, NaCl, ammonium carbamate, ammonium carbonate, naphthalene, etc.

The thickness of the layer applied by dry rolling, on one or both sides, is, in particular, about 50 to 400 μm, corresponding to an application of about 30 to 160 mg/cm$^2$, in particular about 40 to 90 mg/cm$^2$, of powder mixture. Application of the metal powder to the support by rolling takes place under a relatively low pressure of, in particular, about 0.5 to 10 bar.

Electrochemical consolidation is effected by metal deposition at a current density preferably chosen in the range from about 0.1 to 10 A/dm$^2$. Nickel or a nickel alloy having a soluble component is preferably deposited.

The consolidation of the layer applied by dry rolling, which consolidation extends to the support and is effected by electrodeposition of metal, is particularly important and is influenced by various techniques. Such techniques include: appropriate choice of the contact pressure with regard to the formation of optimum (coarse pore) dry layer porosity which, in the electrodeposition of the consolidating metal, also makes accessible the regions close to the support; increasing the current density during electrochemical consolidation; producing a coarse-pore structure of the layer applied by dry rolling, by the concomitant use of a removable filler, which is removed again before the electrochemical consolidation; and changing the electrical conductivity of the powder mixture during the electrochemical consolidation, in which surface oxidation of the powder particles, which decreases from the surface of the layer applied by dry rolling toward the support at the beginning of electrodeposition, ensures that initially metal deposition occurs in regions close to the support, while, with progressive electrodeposition in the nickel bath, the oxide layer is removed so that finally the outermost regions are also included in the electrochemical consolidation. Such superficial oxidation of the surface is achieved, in particular, by pretreatment of the powder in air at about 200° C.

The depth gradation of the superficial oxidation of the powder of the layer applied by dry rolling can be achieved in various ways. For example, initially superficially oxidized powder can be sieved onto a flat substrate and then a plurality of powder layers of decreasing superficial oxidation can be applied, after which the substrate (in particular perforated sheet metal) is placed on top and consolidation is then effected by rolling. The resulting layer displays decreasing superficial oxidation from the outer layer surface inward toward the support.

The invention is described below with reference to illustrative examples:

EXAMPLE 1

A perforated nickel sheet having a thickness of 0.5 mm, a transparency of 35% and a hole diameter of 1 mm was roughened on both sides by electrochemical fixing of suspended INCO carbonyl nickel powder (having a small particle size, irregular shape and high surface activity).

A dry mixture of Ni/Al and carbonyl nickel (1:1) was applied, by rolling, to both sides of the roughened layers thus obtained, in a layer thickness of about 200 μm in each case and under a pressure of 5 bar. This dry mixture is capable of adhering relatively firmly in the roughened matrix, while the transparent areas (holes) remain free. Sheet metal obtained in this manner and provided with a powder mixture which can be activated can be moved freely without danger and immersed in an electrolyte (Watts-type bath). The final mechanical fixing of the metal powder by electrolytically deposited nickel was then carried out in this electrolyte. The duration of electrolysis was 1 hour at a bath temperature of 30° C. and a current density of 1 A/dm$^2$. The electrode element obtained can be activated and is generally activated in situ directly during use.

EXAMPLE 2

Nickel net having a wire thickness of 0.2 mm and a mesh size of 0.5 mm was coated with a binder-free, dry mixture of Ni-Al/Mo/carbonyl nickel (0.45:0.05:0.5) on both sides by roller coating as in Example 1, each coat being about 200 μm. The powder mixture adheres firmly to the net, so that it can be handled without special precautions and can be immersed in an electrolyte. Since binders, which could interfere with the subsequent electrolysis, were not used, electrochemical coating is possible in a conventional Watts-type nickel-plating bath. The final electrochemical fixing and consolidation of the powder mixture on the net was then carried out in this bath under electrolysis conditions as in Example 1.

EXAMPLE 3

A perforated nickel sheet superficially roughened by deposition of carbonyl nickel powder, as in Example 1, was provided on both sides with a layer of powder mixture, which was applied by dry rolling and consisted of Ni-Al and carbonyl nickel (1:1), with the addition of 10% of NaCl having a particle size of 50 to 100 μm. The procedure was otherwise as in Example 1, except that NaCl was dissolved away with water before the electrolysis in the Watts-type bath.

By the concomitant use of NaCl to produce the layer applied by dry rolling and then leached before the electrolysis, the said layer acquires a "loose" structure, which permits extensive electrochemical consolidation of the layer by means of deposited nickel.

EXAMPLE 4

The procedure was once again as in Example 1, except that a catalytically active non-metallic powder of $MoS_2$ was used instead of the Ni-Al capable of activation of alkali treatment.

EXAMPLE 5

The procedure was once again as in Example 1, except that, before application by rolling, half the dry powder mixture of Ni-Al and carbonyl nickel was oxidized at 200° C. in air for 2 hours, with the result that the surface of the powder particles was provided with a thin oxide layer. The two halves of the powder were spread out in succession on a flat substrate with the superficially oxidized material underneath, and were then united, by dry rolling, with the roughened perforated sheet metal placed on top.

In the subsequent electrochemical fixing, metal deposition then begins in the inner regions of the layer applied by dry rolling and then continues toward the surface in the course of the electrolysis, with gradual dissolution of the oxide skins of the outer region in the acidic electrolyte.

Good consolidation of the inner regions too is achieved by this technique.

EXAMPLE 6

The electrodes produced according to Examples 1 to 3 were activated by treatment in hot KOH solution in a conventional manner and then used as electrodes (anode and cathode) in alkaline water electrolysis. At a current density of 400 mA/cm$^2$ and an electrolyte temperature of 100° C., cathodic overvoltages of less than 80 mV and anodic overvoltages of less than 250 mV were obtained. These values indicate that the electrodes obtained according to Examples 1 to 3 have excellent catalytic activity.

EXAMPLE 7

The electrode produced according to Example 4 and containing molybdenum sulfide was used directly as the cathode in alkaline water hydrolysis operated at 100° C. and at current densities of 400 mA/cm$^2$. An overvoltage of 140 mV was obtained here.

EXAMPLE 8

The procedure was once again as in Example 1, except that a catalytically active non-metallic powder of $Co_3O_4$ was used. This kind of electrodes can be used as catalytically active anodes for the advanced alkaline water electrolysis.

What is claimed is:

1. A process for the production of porous electrodes which comprises the steps of:

applying by dry rolling to at least one side of a framework-forming metallic support having adhesion-promoting surface roughness a layer which comprises a powder mixture comprising:

(a) finely divided carbonyl metal having a low bulk density and high frictional resistance, and (b) a pulverulent component comprising a compound which is catalytically active or a compound which can be activated by alkali treatment, wherein the ratio of component (a) to component (b) is between about 3:1 and 1:3; and consolidating said layer by electrochemical coating with metal.

2. A process as claimed in claim 1, wherein said pulverulent component is a compound which can be activated by alkali treatment, and which further comprises the step of activating said layer.

3. A process as claimed in claim 1, wherein said support is a fine-mesh metal net.

4. A process as claimed in claim 3, wherein said metal net is a nickel net.

5. A process as claimed in claim 1, wherein said support is a perforated metal sheet roughened by powder deposition.

6. A process as claimed in claim 5, wherein said support is a perforated nickel sheet roughened by deposition of carbonyl nickel powder.

7. A process as claimed in claim 1, wherein component (a) of said powder mixture is carbonyl iron powder.

8. A process as claimed in claim 1, wherein component (a) of said powder mixture is carbonyl nickel powder.

9. A process as claimed in claim 8, wherein said carbonyl nickel powder has a particle size of about 2 to 3 $\mu$m and a bulk density of about 0.5 to 0.7 g/cm$^2$.

10. A process as claimed in claim 1, wherein said powder mixture consists of approximately equal amounts of carbonyl nickel and Raney nickel alloy.

11. A process as claimed in claim 1, wherein component (b) of said powder mixture comprises nickel sulfide, molybdenum sulfide, cobalt oxide or an alloy of molybdenum or nickel with aluminum, zinc or tin.

12. A process as claimed in claim 1, wherein component (b) of said powder mixture has a particle size of about 10 to 100 $\mu$m.

13. A process as claimed in claim 1, wherein the powder layer applied by dry rolling has a thickness of about 50 to 400 $\mu$m.

14. A process as claimed in claim 1, wherein said consolidation is effected using a current density of about 0.1 to 10 A/dm$^2$.

15. A process as claimed in claim 14, wherein said consolidation is effected by deposition of nickel.

16. A process as claimed in claim 14, wherein said consolidation is effected by deposition of a nickel alloy having a soluble component.

17. A process as claimed in claim 16, wherein said nickel alloy is nickel-zinc or nickel-tin.

18. A process as claimed in claim 1, wherein said application of the powder layer or layers to the support by dry rolling is effected under a pressure of about 0.5 to 10 bar.

19. A process as claimed in claim 1, wherein said powder mixture further comprises about about 5 to 20% by weight, based on the total weight of said components (a) and (b) of a removable filler.

20. A process as claimed in claim 19, wherein said filler comprises KCl, NaCl, ammonium carbamate, ammonium carbonate or naphthalene.

21. A porous electrode produced by the process of claim 1.

22. A process as claimed in claim 1, wherein said layer comprises a plurality powder layers of decreasing superficial oxidation from the outer layer surface inward toward the support.

23. A porous electrode produced by the process of claim 22.

24. A process for the production of porous electrodes which comprises the steps of:

preparing a powder mixture comprising:

(a) finely divided carbonyl metal having a low bulk density and high frictional resistance; and (b) a pulverulent component comprising a compound which is catalytically active or a compound which can be activated by alkali treatment, wherein the ratio of component (a) to component (b) is between about 3:1 and 1:3;

dividing said powder mixture into a plurality of portions;

superficially oxidizing at least one portion of said powder mixture;

applying to at least one side of a framework-forming metallic support having adhesion-promoting roughness a layer formed by a process comprising the steps of:

(i) superimposing on a flat substrate said plurality of powder mixture portions in order of decreasing superficial oxidation;

(ii) superimposing said metallic support on said powder layers;

(iii) uniting said powder layers and said metallic support by dry rolling; and (iv) removing said flat substrate; and consolidating the combined powder layer by electrochemical coating with metal.

25. A process as claimed in claim 4, wherein said pulverulent component is a compound which can be activated by alkali treatment, and which further comprises the step of activating said layer.

26. A process as claimed in claim 24, wherein said superficial oxidation is achieved by pretreatment of said powder mixture in air at about 200° C.

27. A process as claimed in claim 24, wherein about 50% of the powder mixture is superficially oxidized.

28. A porous electrode produced by the process of claim 24.

* * * * *